US006287148B1

(12) United States Patent
Huang

(10) Patent No.: US 6,287,148 B1
(45) Date of Patent: Sep. 11, 2001

(54) ELECTRICAL CONNECTOR AND METHOD FOR MOUNTING THE SAME ON AN ELECTRICAL CABLE

(76) Inventor: George Ying-Liang Huang, 8F, No. 435, Rei-Kuang Rd., Nei-Hu Dist., Taipei City (TW)

( * ) Notice: Subject to any disclaimer, the term of this patent is extended or adjusted under 35 U.S.C. 154(b) by 0 days.

(21) Appl. No.: 09/533,910

(22) Filed: Mar. 23, 2000

(51) Int. Cl.[7] ..... H01R 13/42
(52) U.S. Cl. ..... 439/610
(58) Field of Search ..... 439/610, 607

(56) References Cited

U.S. PATENT DOCUMENTS

| | | | | |
|---|---|---|---|---|
| 4,786,260 | | 11/1988 | Spaulding | 439/607 |
| 5,197,900 | | 3/1993 | Ellis et al. . | |
| 5,562,497 | * | 10/1996 | Yagi et al. | 439/610 |

FOREIGN PATENT DOCUMENTS 2 121 618 A 12/1983 (GB) .

* cited by examiner

*Primary Examiner*—Renee Luebke
(74) *Attorney, Agent, or Firm*—Akin, Gump, Strauss, Hauer & Feld, L.L.P.

(57) ABSTRACT

An electrical connector includes an insulator body with a terminal pin unit, a metal housing, and a metal protective shield. The electrical connector is mounted on an electrical cable that transmits signals between electrical equipment by a process, which includes the steps of:

(1) passing the cable through the shield to connect electrically with the terminal pin unit on the insulator body;
(2) placing the insulator body into the shield in such a manner that the terminal pin unit is exposed partially to exterior of the shield;
(3) fastening the housing onto the shield so as to clamp the insulator body between the housing and the shield; and
(4) pressing inwardly and sleeving tightly a portion of the shield on the cable.

4 Claims, 14 Drawing Sheets

ELECTRICAL CONNECTOR AND METHOD FOR MOUNTING THE SAME ON AN ELECTRICAL CABLE

BACKGROUND OF THE INVENTION

1. Field of the Invention

This invention relates to an electrical connector, which is connected electrically to an electrical cable that transmits electrical signals between electrical equipment, more particularly to an electrical connector and a method for mounting the same on an electrical cable.

2. Description of the Related Art

Referring to FIGS. 1 and 2, a conventional electrical connector is shown to include an insulator body 11, a front metal housing 12, and a rear metal housing 13. The insulator body 11 has a plurality of parallel terminal pins 111 that extend therethrough, and a shoulder 112. The front metal housing 12 defines a terminal opening 121 therein, and has a rear end that is formed with an outwardly extending flange 122. The rear metal housing 13 has a front end that is formed with an outwardly extending flange 131, and a rear end that is formed with an inwardly extending flange 132. The flanges 122 and 131 abut against each other, and are formed with holes 14 for interconnecting the flanges 122 and 131 by rivets (not shown). In this way, the insulator body 11 is clamped between the front and rear metal housings 12 and 13. The insulator body 11 has a rear end, which abuts against the inwardly extending flange 132 of the rear metal housing 13. The terminal pins 111 have front ends, which are exposed within the terminal opening 121 in the front metal housing 12. The rear metal housing 13 is disposed normally within a metal shield. For example, referring to FIGS. 3 and 4, in a first conventional electrical connector, the rear metal housing 13 is fixed within a front opening 151 in a unitary metal protective shield 15 by pressing a front end of the shield 15 to form an inwardly extending annular projection 155 after the rear metal housing 13 has been inserted into the shield 15. The shield 15 has a rear end opening 153, through which an electrical cable (not shown) passes for electrical connection with the terminal pins 111. When the front end of the shield 15 is pressed to form the projection 155, the shield 15 easily deforms, thereby resulting in the formation of voids between the rear metal housing 13 and the shield 15. As a result, the rear metal housing 13 cannot be connected firmly to the shield 15. Furthermore, electromagnetic interference in the first conventional electrical connector is increased.

Referring to FIGS. 5 and 6, in a second conventional electrical connector, the rear metal housing 13 is fixed between an upper metal housing 16 and a lower metal housing 17, which are interconnected by virtue of engagement between inwardly pressed portions 161 of the upper metal housing 16 and rectangular grooves 171 in the lower metal housing 17. An annular welding joint(not shown) is formed between the rear metal housing 13 and the upper metal housing 16 and between the rear metal housing 13 and the lower metal housing 17 for reducing electromagnetic interference in the second conventional electrical connector, thereby resulting in waste of time when the second conventional electrical connector is mounted on an electrical cable (not shown). Furthermore, the insulator body in the rear metal housing 13 melts partially due to high temperatures resulting from the formation of the annular welding joint.

Referring to FIG. 7, in a third conventional electrical connector, the rear metal housing 13 is fixed between an upper metal housing 21 and a lower metal housing 23. Each of the upper and lower metal housings 21, 23 is formed with a hook edge 25, which is inserted into a respective one of two mounting slots 133 in the rear metal housing 13. As such, it is time-consuming to mount the third conventional electrical connector on an electrical cable (not shown) . Because voids are created unavoidably among the housings 13, 21, 23, electromagnetic interference in the third conventional electrical connector is also increased.

Referring to FIG. 8, in a fourth conventional electrical connector, the rear metal housing (not shown) is fixed between an upper metal housing 22 and a lower metal housing 24, each of which is formed with a holding edge 26 at a front end thereof for holding the front metal housing 12 thereon. The fourth conventional electrical connector suffers from the same drawbacks as the third conventional electrical connector.

SUMMARY OF THE INVENTION

An object of this invention is to provide an electrical connector, which reduces electromagnetic interference.

Another object of this invention is to provide an electrical connector, which has a relatively high mechanical structural strength without pouring insulating plastic material in a metal protective shield.

Still another object of this invention is to provide a method for mounting an electrical connector on an electrical cable, which can be effected easily.

According to this invention, an electrical connector includes an insulator body with a terminal pin unit, a metal housing, and a metal protective shield. The electrical connector is mounted on an electrical cable that transmits signals between electrical equipment by a process, which includes the steps of:

(1) passing the cable through the shield to connect electrically with the terminal pin unit on the insulator body;

(2) placing the insulator body into the shield in such a manner that the terminal pin unit is exposed partially to exterior of the shield;

(3) fastening the housing onto the shield so as to clamp the insulator body between the housing and the shield; and (4) pressing inwardly and sleeving tightly a portion of the shield on the cable.

Because the insulator body is clamped directly between the housing and the shield, and because the electrical connector is composed of a relatively small number of parts, electromagnetic interference in the electrical connector is reduced.

The shield can have a thickness large enough to increase the mechanical structural strength thereof, without the need for pouring insulating plastic material therein.

Furthermore, because the number of the parts of the electrical connector is reduced, the electrical connector can be mounted easily on the electrical cable.

BRIEF DESCRIPTION OF THE DRAWINGS

These and other features and advantages of the invention will become apparent in the following detailed description of the preferred embodiments, with reference to the accompanying drawings, in which.

DETAILED DESCRIPTION OF THE PREFERRED EMBODIMENTS

Before the preferred embodiments are described in detail, it is noted that like numerals designate similar elements or structures throughout the whole description of the preferred embodiments.

Figure 1:
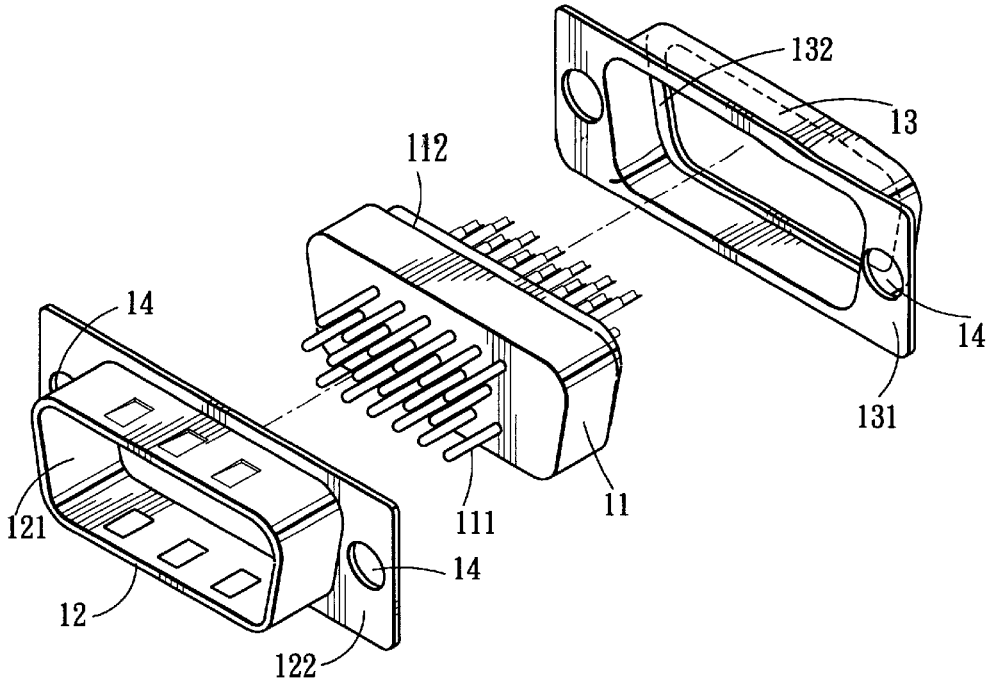
FIG.1 PRIOR ART
FIGS. 1 and 2 illustrate how an insulator body is disposed between front and rear metal housings in a conventional electrical connector.
Figure 2:
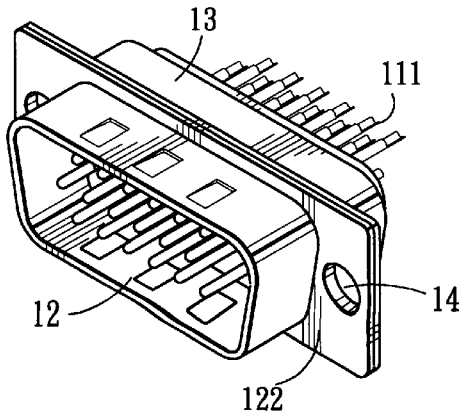
FIG.2 PRIOR ART
Figure 3:
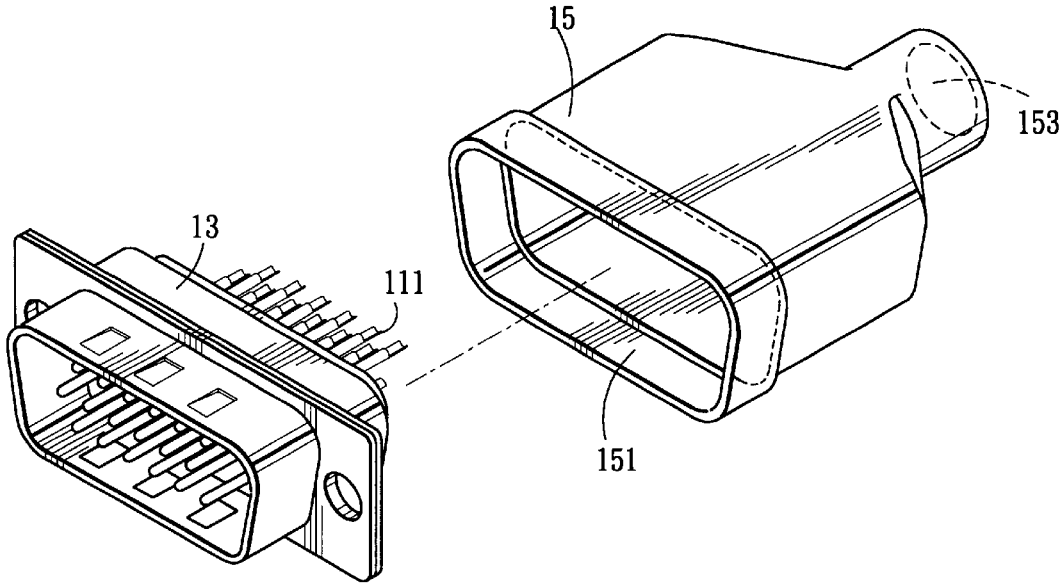
FIG. 3 PRIOR ART
FIG. 3 is an exploded perspective view of a first conventional electrical connector.
Figure 4:
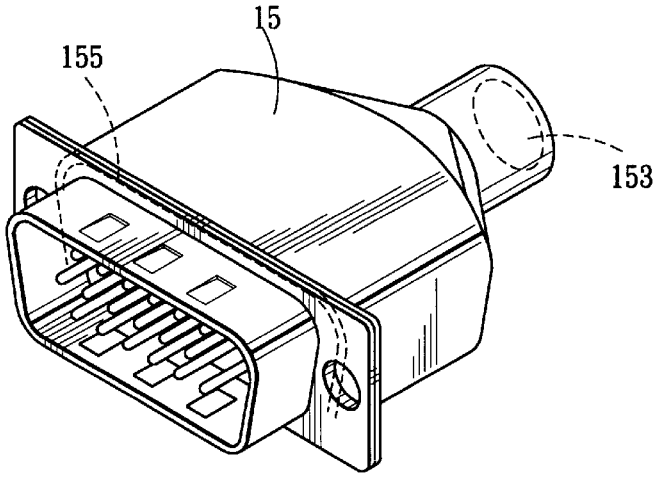
FIG. 4 PRIOR ART
FIG. 4 is an assembled perspective view of the first conventional electrical connector.
Figure 5:
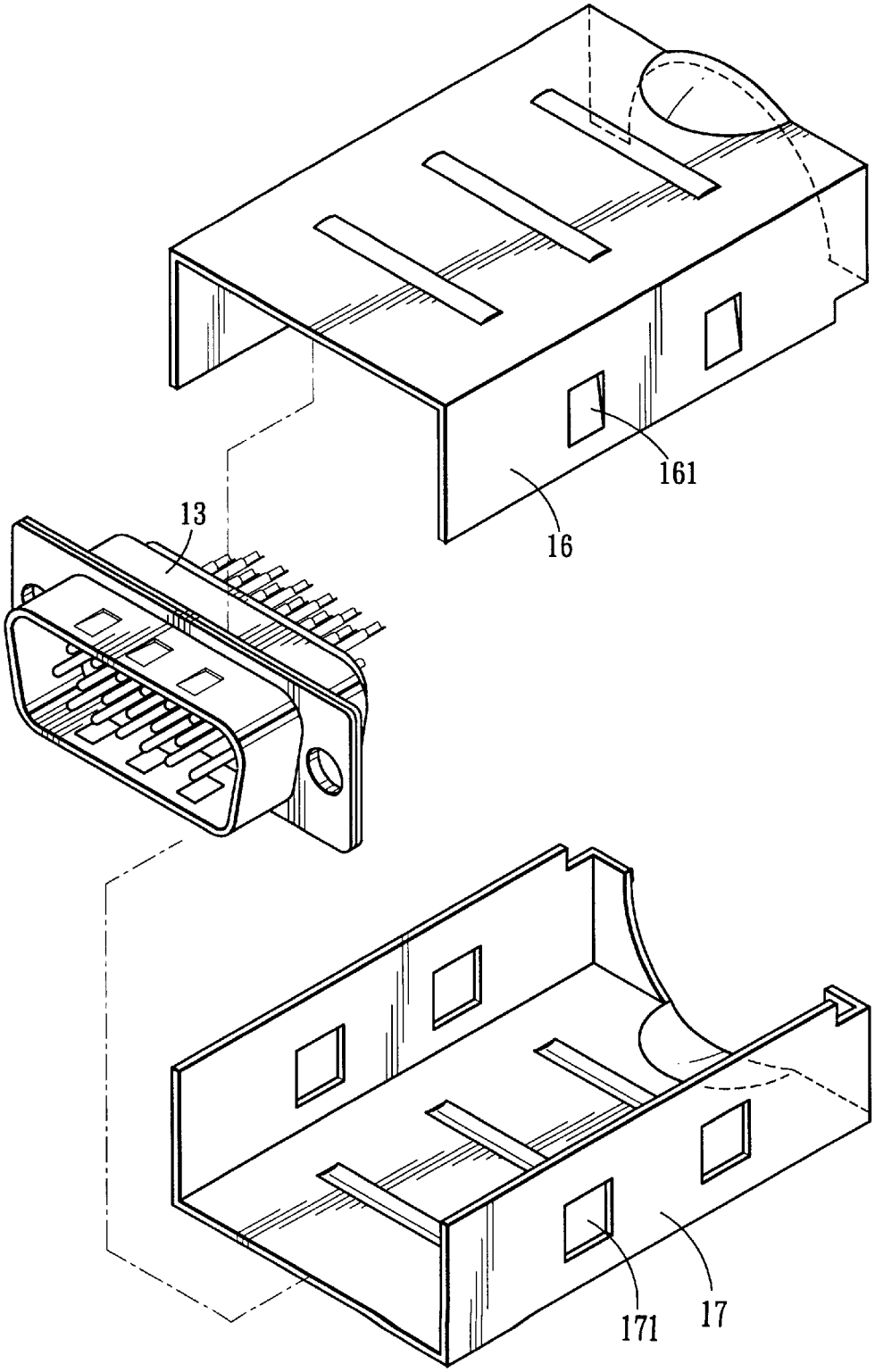
FIG. 5 PRIOR ART
FIG. 5 is an exploded perspective view of a second conventional electrical connector.
Figure 6:
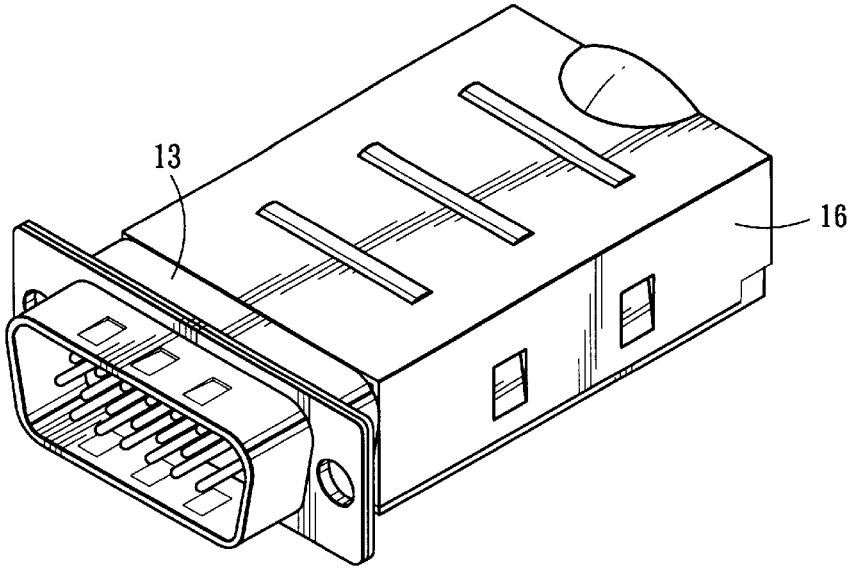
FIG. 6 PRIOR ART
FIG. 6 is an assembled perspective view of the second conventional electrical connector.
Figure 8:
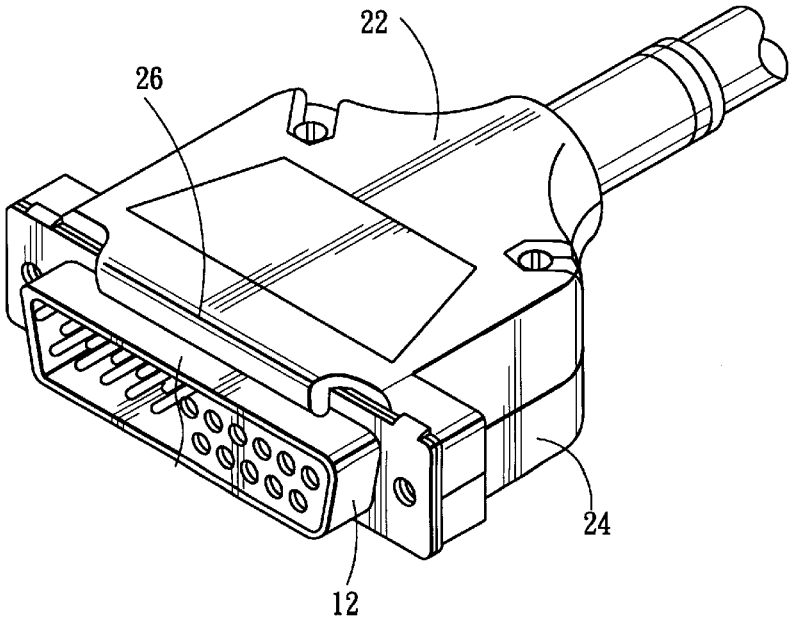
FIG. 8 PRIOR ART
FIG. 8 is an assembled perspective view of a fourth conventional electrical connector.
Figure 7:
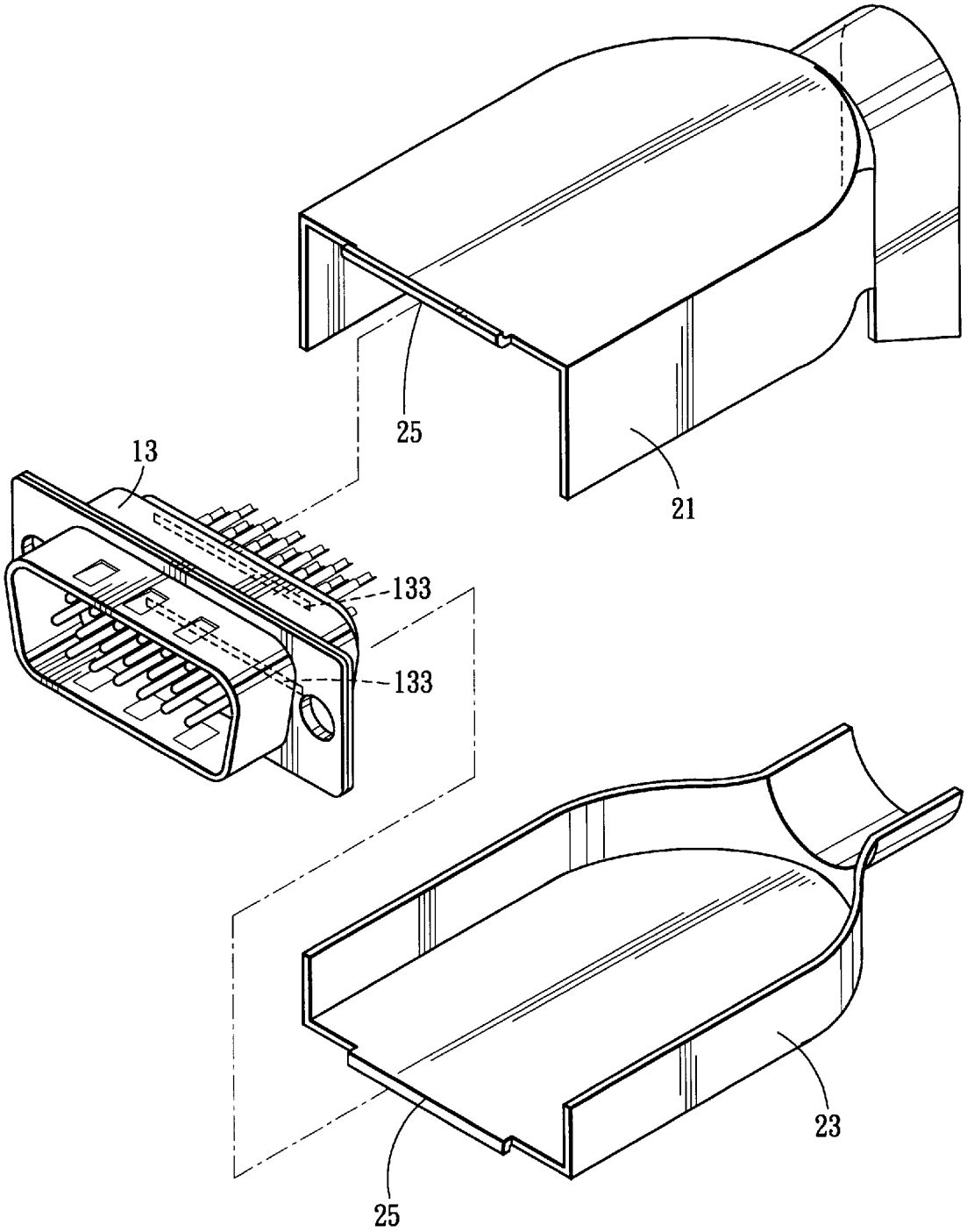
FIG. 7 PRIOR ART
FIG. 7 is an exploded perspective view of a third conventional electrical connector.
Figure 9:
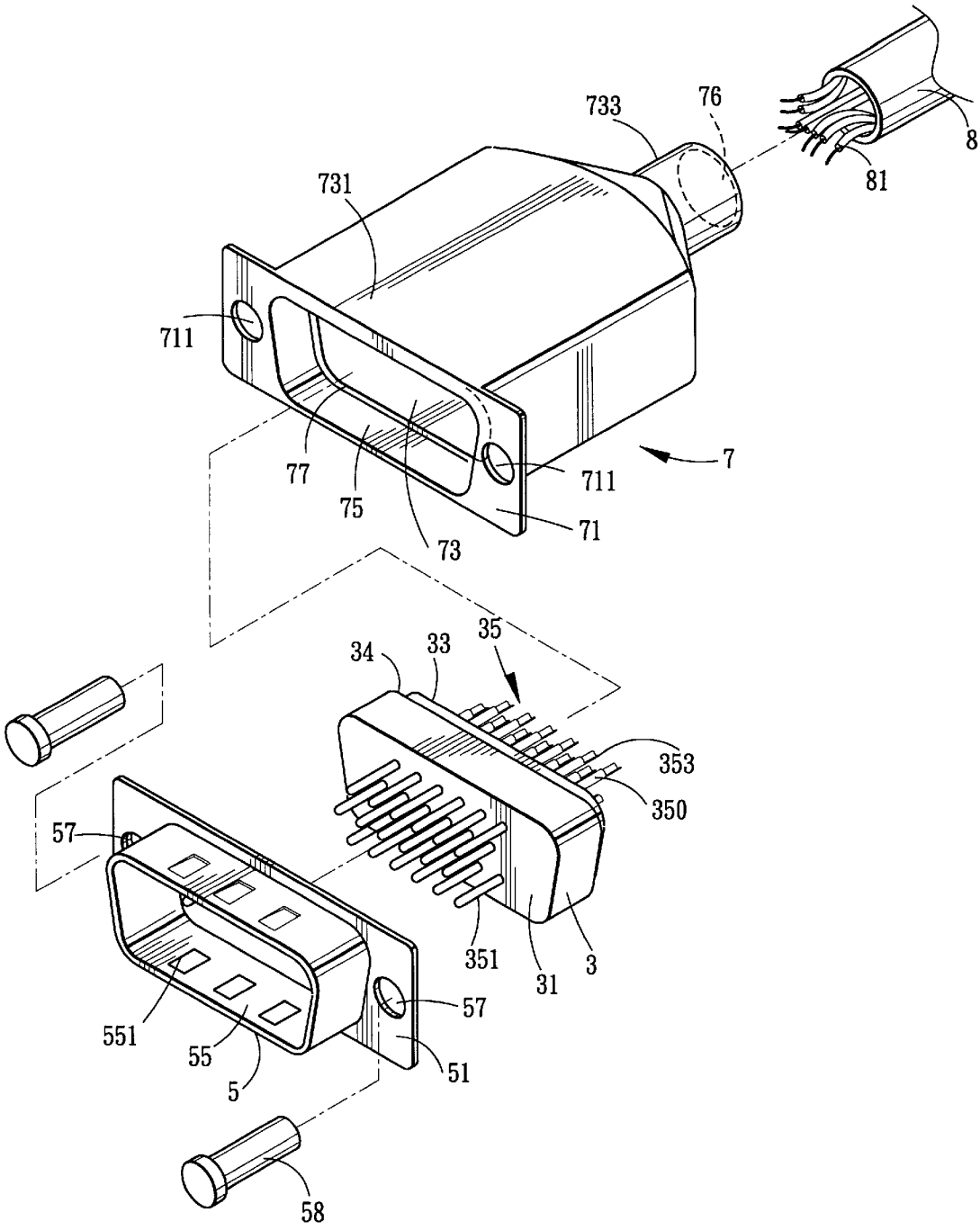
FIG. 9 is an exploded perspective view of a first preferred embodiment of an electrical connector according to this invention.
Figure 10:
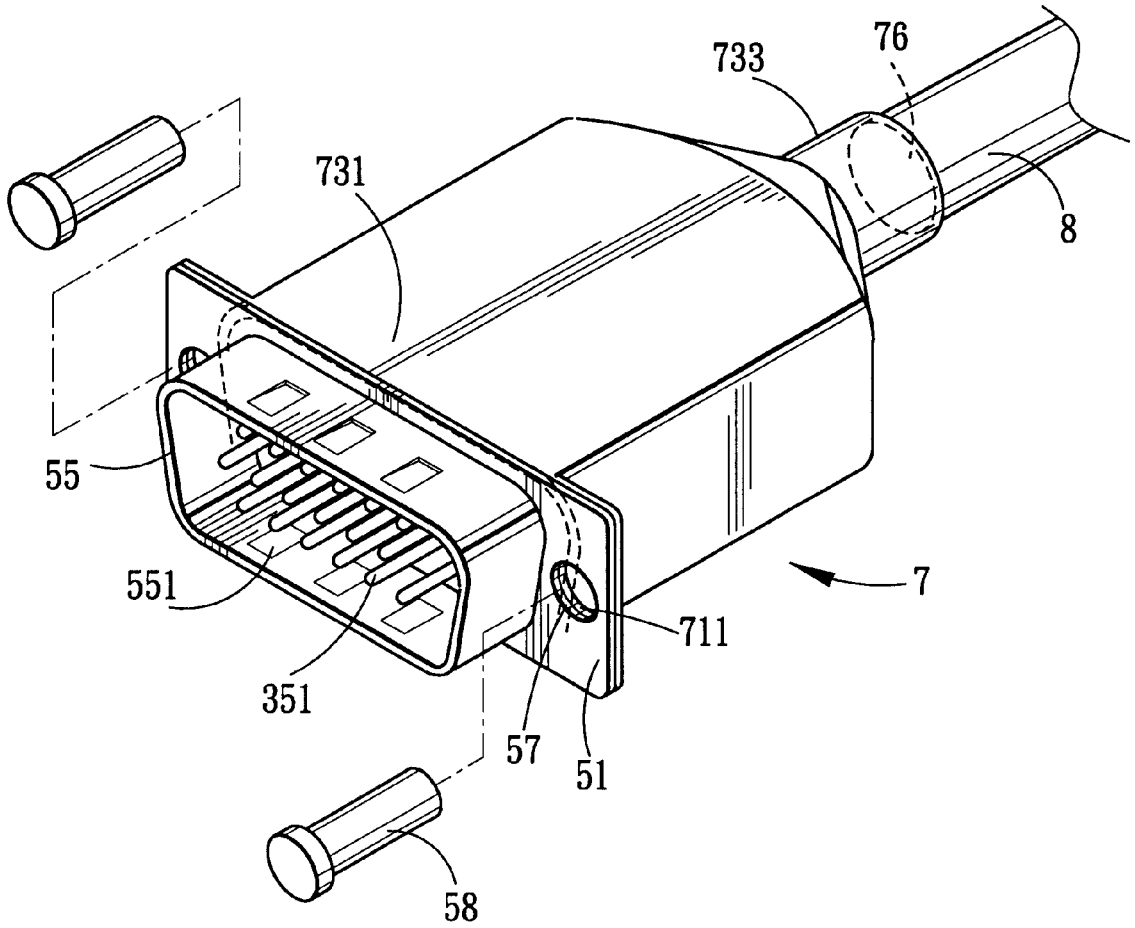
FIG. 10 is an assembled perspective view of the first preferred embodiment.

Referring to FIGS. 9 and 10, a first preferred embodiment of an electrical connector according to this invention is shown to include an insulator body 3, an annular metal housing 5, and a tubular unitary metal protective shield 7.

The electrical connector is adapted to be connected to an electrical cable 8 that is disposed behind the electrical connector and that has a plurality of signal lines 81.

The insulator body 3 has a front face 31, a rear face 33 that is opposite to the front face 31, a shoulder 34, and a terminal pin unit 35, which includes a plurality of parallel pins 350 that extend through the insulator body 3. Each of the pins 35 has a front end 351 that extends from the front face 31, and a rear end 353 that extends from the rear face 33.

The housing 5 has a rear end formed with an outwardly extending flange 51, and defines a terminal opening 55 in the housing 5. Six inwardly extending reinforcing projections 551 are formed on the housing 5 for pressing against another electrical connector (not shown), which is inserted into the terminal opening 55. Two holes 57 are formed through the flange 51 on two sides of the terminal opening 55.

The shield 7 has open front and rear ends, which are adapted for passage of the cable 8 through the shield 7 to connect with the rear ends of the pins 350 electrically. The shield 7 defines a hole 73 therein, which has an enlarged front end portion 75 that is defined in front of a shoulder 77 so as to receive the insulator body 3 fittingly therein, and a rear end 76, into which the cable 8 is inserted. The front end of the shield 7 is formed with an outwardly extending flange 71, which abuts against the flange 51 of the housing 5 and which is connected fixedly to the flange 51 of the housing 5. Each of the flanges 51, 71 of the housing 5 and the shield 7 has two holes 57, 711 that are formed therethrough on two sides of the terminal opening 55. The electrical connector further includes two rivet elements 58, each of which extends through a respective one of the holes 57 in the housing 5 and a respective one of the holes 711 in the shield 7 for interconnecting the flanges 51, 71 of the housing 5 and shield 7. In use, the rivet elements 58 are attached to, e.g. a computer housing (not shown). The shield 7 has a generally rectangular containing body 731 and a cylindrical rear end portion 733. Because voids occur only between the flanges 51, 71 of the housing 5 and the shield 7, electromagnetic interference in the electrical connector is reduced significantly.

In this embodiment, the shield 7 is manufactured by a press casting process, and has a thickness, which ranges between 0.6 mm and 1.0 mm. Accordingly, the electrical connector has a relatively high mechanical structural strength.

Figure 11:
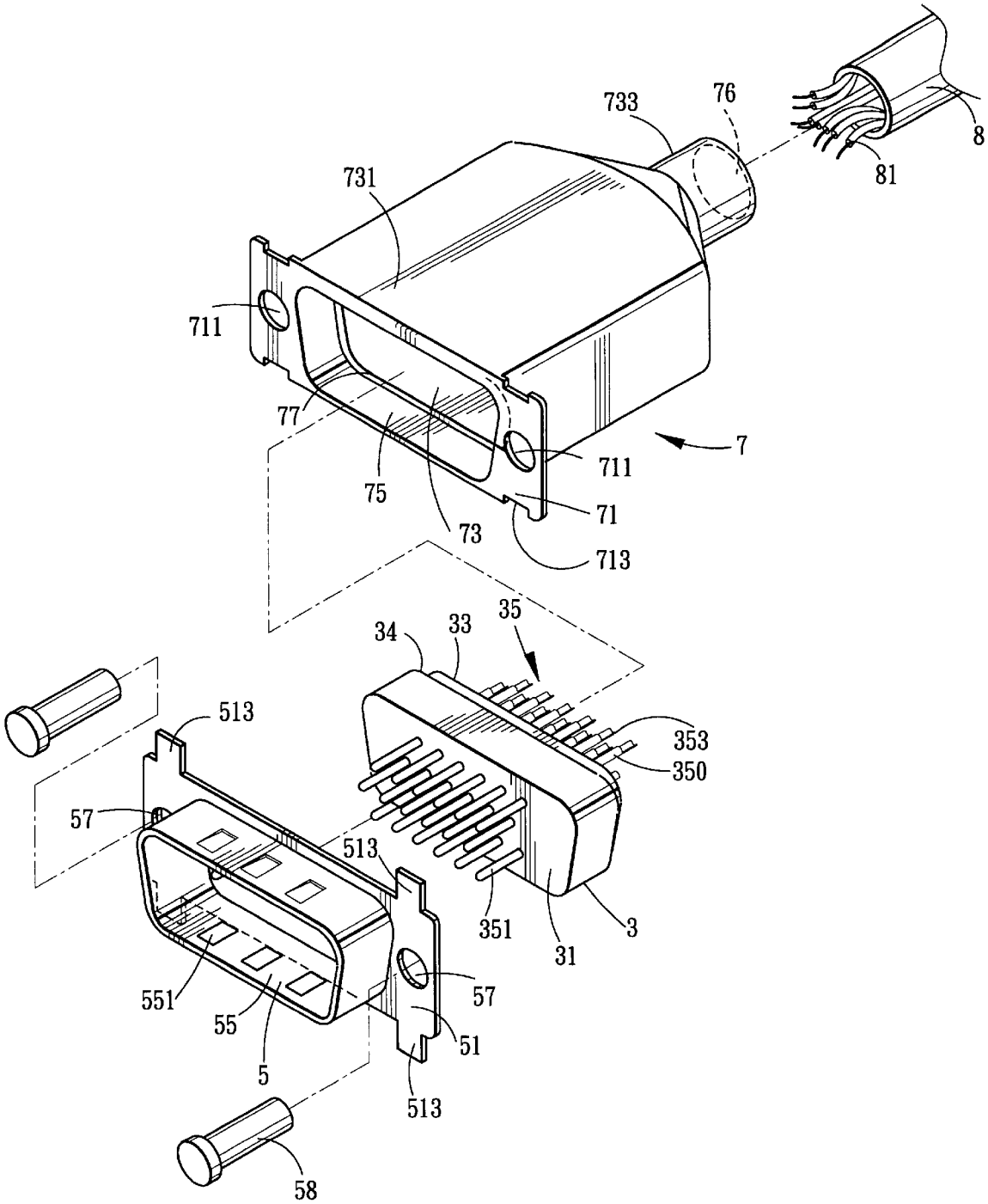
FIG. 11 is an exploded perspective view of a second preferred embodiment of an electrical connector according to this invention.
Figure 12:
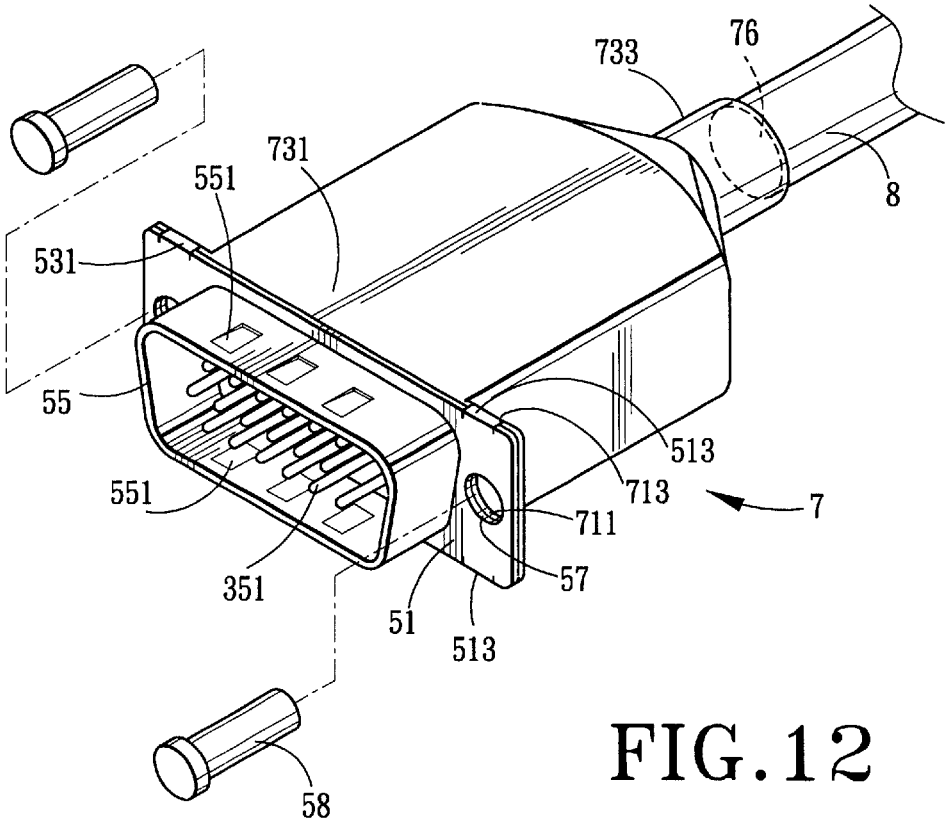
FIG. 12 is an assembled perspective view of the second preferred embodiment.
Figure 12C:
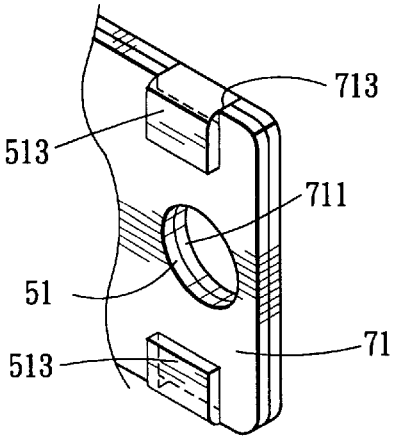
FIG. 12C is a rear view of the flanges of the second preferred embodiment.
Figure 12A:
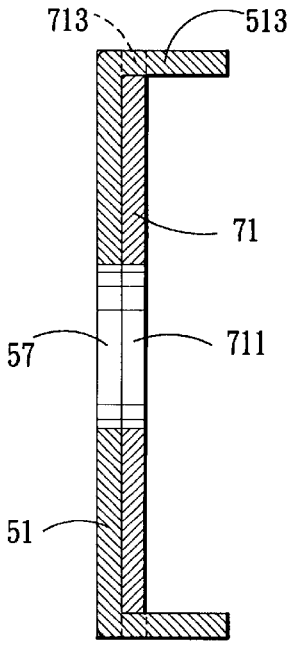
FIGS. 12A and 12B are schematic sectional views illustrating how two flanges of the second preferred embodiment are interconnected.
Figure 12B:
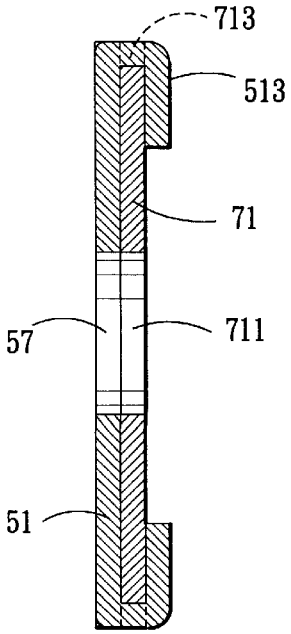

The interconnection between the flanges 51, 71 can be changed. For example, as shown in FIGS. 11 and 12, the flange 71 of the shield 7 is generally rectangular, and has four notches 713 in four corners thereof. The flange 51 of the housing 5 is generally rectangular, and is formed with four integral tongues 513 at four corners thereof, which engage respectively the notches 713 in the flange 71 of the shield 7 and which are bent to clamp the flange 71 of the shield 7 between the flange 51 of the housing 5 and the tongues 513 for fixing the housing 5 relative to the shield 7. It is noted that the tongues 513 are shaped as rectangular plates prior to mounting of the electrical connector on the cable 8, as shown in FIG. 11. The flanges 51, 71 are interconnected by the steps of:

abutting the flange 51 against the flange 71;

bending the tongues 513 by 90 degrees to a position, as shown in FIG. 12A, to engage the notches 713 in the flange 71 of the shield 7; and bending the tongues 513 once again by 90 degrees to a position, as shown in FIGS. 12, 12B, 12C, to clamp the flange 71 of the shield 7 between the tongues 513 and the remaining portion of the flange 51 of the housing 5.

Figure 13:
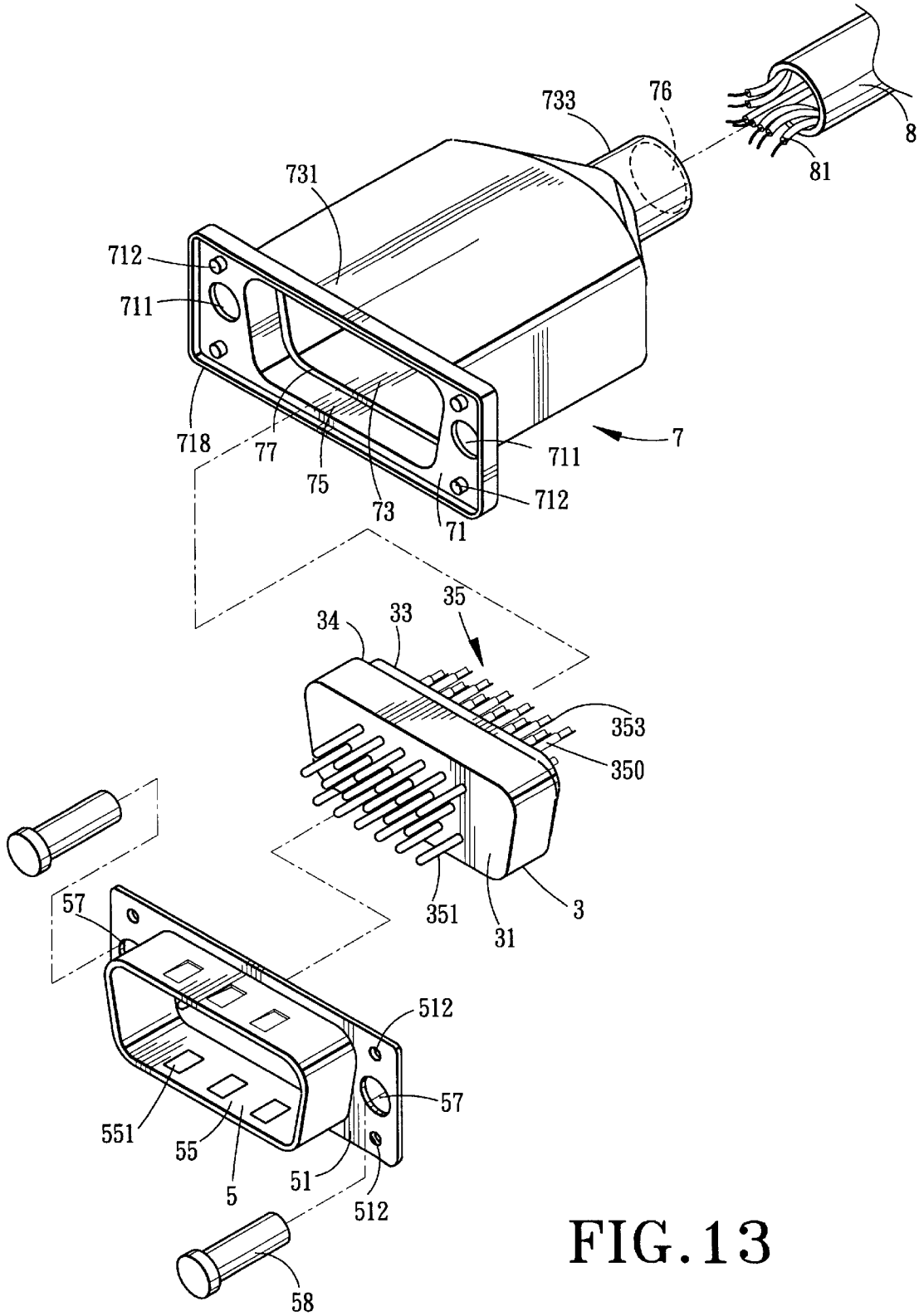
FIG. 13 is an exploded perspective view of a third preferred embodiment of an electrical connector according to this invention.
Figure 14:
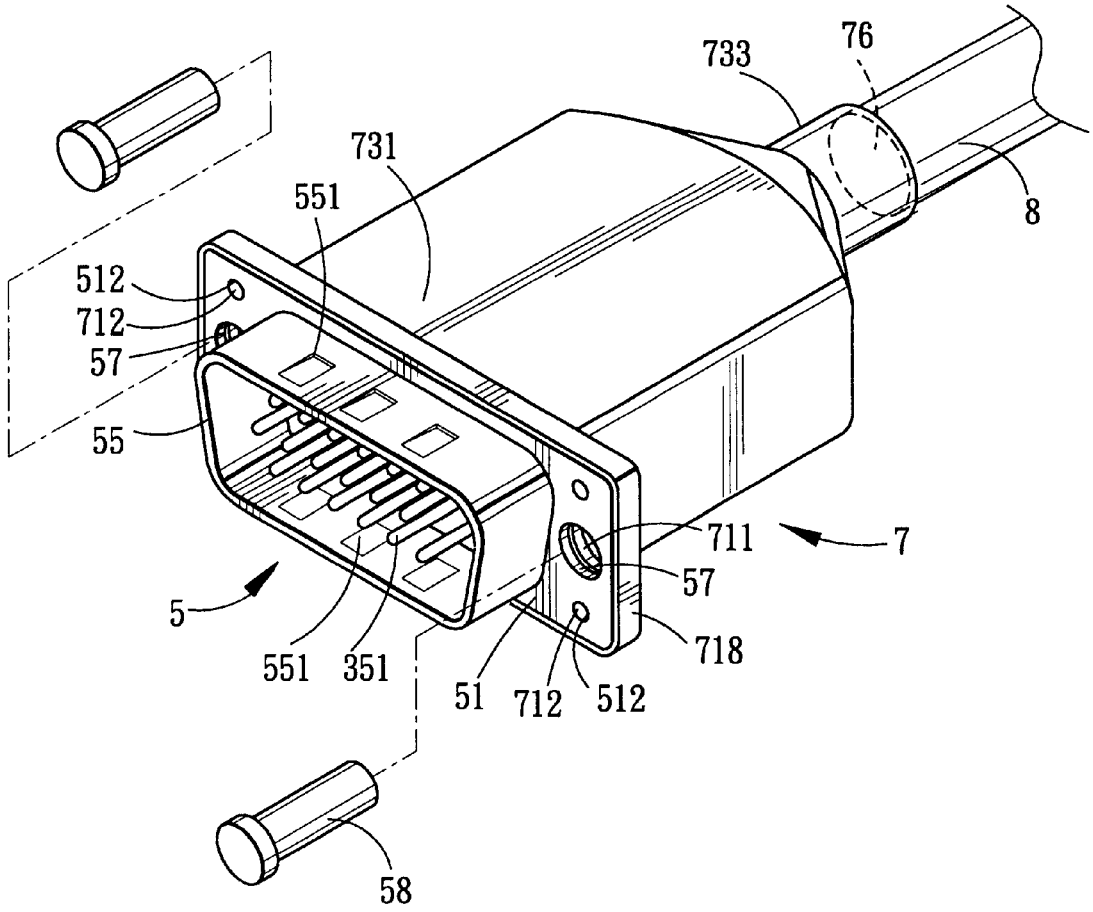
FIG. 14 is an assembled perspective view of the third preferred embodiment.

Alternatively, the flanges 51, 71 can be interconnected in a manner illustrated in FIGS. 13 and 14. As illustrated, the flange 71 of the shield 7 has an outer periphery, which is formed integrally with an endless annular frame 718 that extends axially and outwardly therefrom and that confines the flange 51 of the housing 5 therein, thereby reducing electromagnetic interference in the electrical connector. The flange 71 is formed with four integral projecting posts 712 that engage respectively four holes 512 in the flange 51. The posts 712 have front ends, each of which is hammered to form an enlarged end for preventing separation of the flanges 51, 71. In this embodiment, the rivet elements 58 are secured to a computer housing (not shown). It is noted that the frame 718 may be formed on the flange 51, instead of the flange 71. Further, the positions of the posts 712 and the holes 512 can be interchanged.

Figure 15:
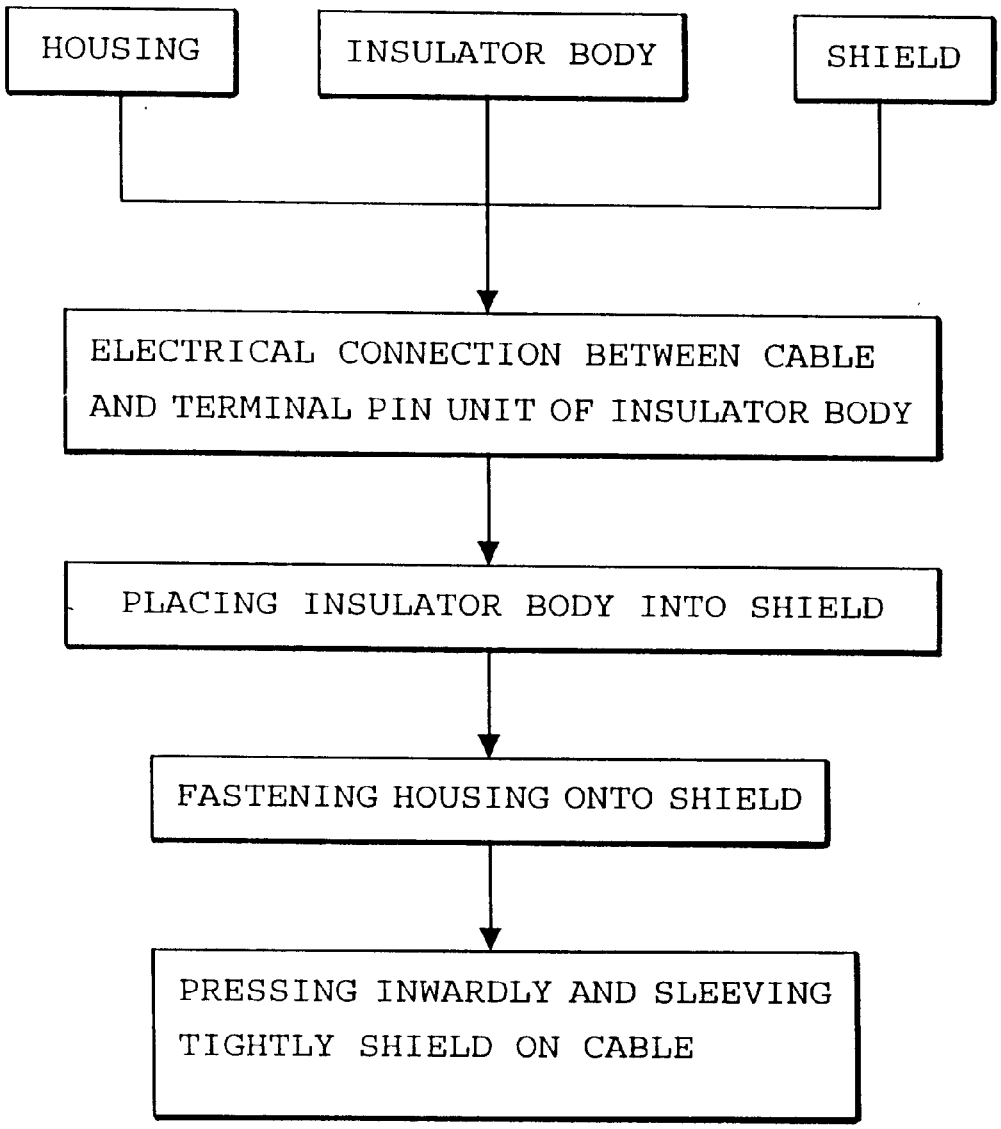
FIG. 15 is a block diagram of a method for mounting the electrical connector on the electrical cable according to this invention.

Referring to FIGS. 9 and 15, the electrical connector of this invention is mounted on the cable 8 by the steps:

(1) passing the cable 8 through the shield 7 to connect electrically with the terminal pin unit 35 of the insulator body 3;

(2) placing the insulator body 3 onto the shield 7 in such a manner that the terminal pin unit 35 is exposed partially to exterior of the shield 7;

(3) fastening the housing 5 into the shield 7 so as to clamp the insulator body 3 between the housing 5 and the shield 7; and (4) pressing inwardly and fitting tightly the rear end portion 733 of the shield 7 on the cable 8.

Before the housing 5 is fastened to the shield 7, an outer surface of the shield 7 can be plated and/or painted.

Because the number of the parts of the electrical connector of this invention is relatively small, the electrical connector can be mounted easily on the cable 8.

Figure 16:
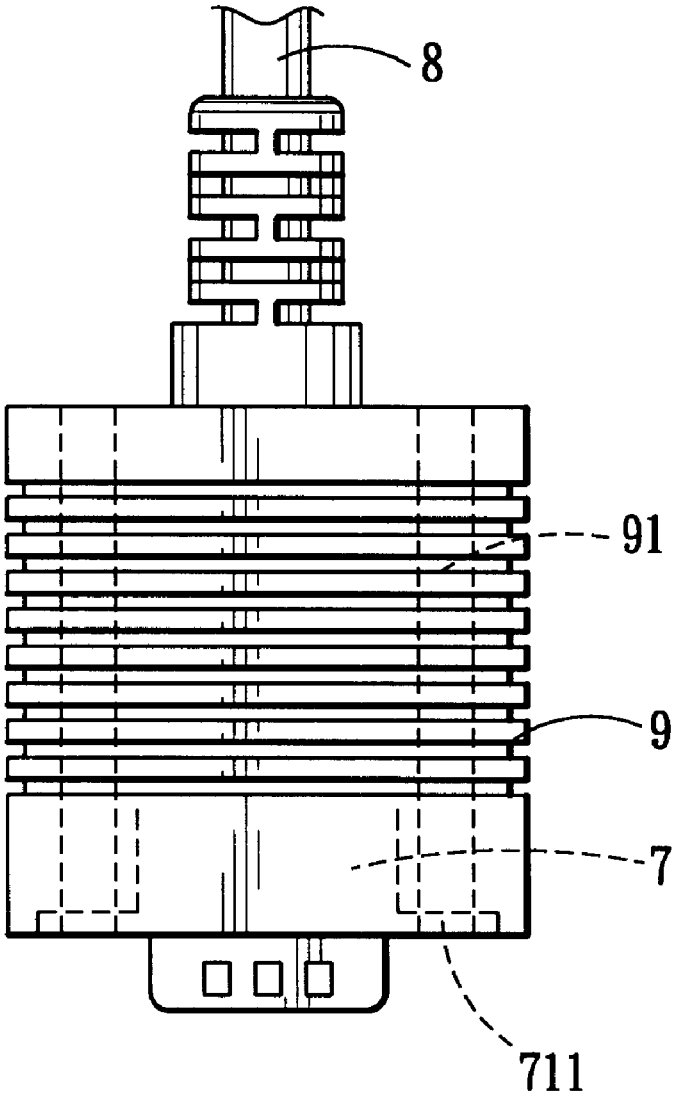
FIG. 16 is a schematic top view illustrating how an insulating housing is injection molded on the electrical connector of this invention.

Preferably, after the rear end portion 733 of the shield 7 is press fitted on the cable 8, as shown in FIG. 16, an insulating housing 9 is injection molded on the shield 7. The insulating housing 9 has two holes 91 that are formed therethrough and that are aligned with the holes 711 (see FIG. 9) in the shield 7.

With this invention thus explained, it is apparent that numerous modifications and variations can be made without departing from the scope and spirit of the invention. It is therefore intended that this invention be limited only as indicated by the appended claims.

I claim:

1. An electrical connector adapted to be connected with an electrical cable that is disposed behind said electrical connector, said electrical connector comprising:

an insulator body having a front face, a rear face that is opposite said front face, and a terminal pin unit, said terminal pin unit including a plurality of parallel pins that extend through said insulator body, each of said pins having a front end that extends from said front face of said insulator body, and a rear end that extends from said rear face of said insulator body;

an annular metal housing for defining a terminal opening therein, said housing having a rear end, which is formed with an outwardly extending flange; and a tubular unitary metal protective shield having open front and rear ends, which are adapted for passage of the cable through said shield to connect with said rear ends of said pins electrically, said shield defining a hole therein, which has an enlarged front end portion for receiving said insulator body fittingly therein, said front end of said shield being formed with an outwardly extending flange, which abuts against said flange of said housing and which is connected fixedly to said flange of said housing, one of said flanges of said housing and said shield has an outer periphery formed integrally with an endless annular frame that extends axially and outwardly therefrom and that confines the other one of said flanges of said housing and said shield therein, thereby reducing electromagnetic interference in said electrical connector.

2. The electrical connector as claimed in claim 1, wherein each of said flanges of said housing and said shield has two holes that are formed therethrough on two sides of said terminal opening, said electrical connector further including two rivet elements, each of which extends through a respective one of said holes in said housing and a respective one of said holes in said shield for interconnecting said flanges of said housing and shield.

3.The electrical connector as claimed in claim 1, wherein said flange of said shield is generally rectangular, and has four notches in four corners thereof, said flange of said housing being generally rectangular, and being formed integrally with four integral tongues at four corners thereof, which engage respectively said notches in said flange of said shield and which are bent to clamp said flange of said shield between said flange of said housing and said tongues for fixing said housing relative to said shield.

4. The electrical connector as claimed in claim 1, further comprising an insulating housing, which is injection molded on said shield.

* * * * *